US006729164B2

(12) United States Patent
Shibata

(10) Patent No.: US 6,729,164 B2
(45) Date of Patent: May 4, 2004

(54) SPORTING STOCKING AND KNITTING METHOD THEREOF

(75) Inventor: Yoshinori Shibata, Sapporo (JP)

(73) Assignee: Spotrend Co., Ltd., Hokkaido (JP)

( * ) Notice: Subject to any disclaimer, the term of this patent is extended or adjusted under 35 U.S.C. 154(b) by 0 days.

(21) Appl. No.: 10/122,203

(22) Filed: Apr. 16, 2002

(65) Prior Publication Data

US 2002/0152773 A1 Oct. 24, 2002

(30) Foreign Application Priority Data

Apr. 23, 2001 (JP) ..... 2001-124459

(51) Int. Cl.[7] ..... A41B 11/00
(52) U.S. Cl. ..... 66/178 R; 2/22; 2/239
(58) Field of Search ..... 66/178 R, 173, 66/172 E, 182, 183, 184, 185, 186, 187, 188; 2/22, 23, 24, 239, 240, 241, 242

(56) References Cited

U.S. PATENT DOCUMENTS 1,225,354 A * 5/1917 Pierce ..... 2/239
1,525,298 A * 2/1925 Hartman ..... 2/24
2,655,660 A * 10/1953 Racz ..... 2/83
3,189,919 A * 6/1965 Chase ..... 2/16
4,001,953 A * 1/1977 Fugere et al. ..... 36/2 R
4,084,584 A * 4/1978 Detty ..... 2/24
4,280,342 A * 7/1981 Eng et al. ..... 66/177
4,669,126 A * 6/1987 Jones ..... 2/22
4,756,026 A * 7/1988 Pierce, Jr. ..... 2/16
4,832,010 A * 5/1989 Lerman ..... 2/24
4,987,613 A * 1/1991 Loverdi et al. ..... 2/23
5,105,473 A * 4/1992 Valtakari ..... 2/461
5,157,791 A * 10/1992 Woodson et al. ..... 2/239
5,537,689 A * 7/1996 Dancyger ..... 2/24
5,555,564 A * 9/1996 Welch ..... 2/239
5,581,817 A * 12/1996 Hicks ..... 2/239
D395,158 S * 6/1998 Lindaman ..... D2/986
6,279,160 B1 * 8/2001 Chen ..... 2/24
6,332,224 B1 * 12/2001 Walker et al. ..... 2/239

* cited by examiner

*Primary Examiner*—Danny Worrell
(74) *Attorney, Agent, or Firm*—Sughrue Mion, PLLC

(57) ABSTRACT

A sporting stocking is capable of fitting pads at respectively predetermined positions only by selecting appropriate size of stocking and is not required to fit the protector by means of the accessory, to insert the protector into the pocket or to engage with the engaging member on the stocking. The sporting stocking includes a stocking body, and at least one of shank front pad, a shank back pad and a patella pad fitted on the stocking body in non-removably integrated at predetermined positions.

8 Claims, 11 Drawing Sheets

SPORTING STOCKING AND KNITTING METHOD THEREOF

BACKGROUND OF THE INVENTION

1. Field of the Invention

The present invention relates to a sporting stocking and a knitting method thereof.

2. Description of the Related Art

In various sports, such as association football, a protector, called as shank guard, leg guard and so forth is used for protecting player's leg, such as anticoagulation or the like.

The protectors are provided in various types. For example, one type of protectors are fit on the player's leg by means of accessory, such as belt or the like, another type of protectors are fitted by setting in a pocket or engaging tool provided in a stocking. Namely, various types of protectors, such as for detachably fitting on worn stocking and so forth, are available.

However, any types of protectors are manufactured separately from the stockings. Accordingly, upon use, in addition to wearing of stocking, attaching and detaching of by accessory, inserting and withdrawal into and from the pocket of the stocking, namely attaching and detaching of the protector becomes necessary to trouble the player.

Furthermore, the protector originally gives uncomfortable feeling, the player tends to neglect using. Also, the player may forget fitting of the protector.

Also, even when the player fits the protector, the protector fitted by the accessory or pocket can be displaced during playing.

In addition, the protector is provided separately from the stocking, storing and washing have to be done separately. Furthermore, since the stocking and the protector are provided separately, cost becomes high.

SUMMARY OF THE INVENTION

It is an object of the present invention to provide a sporting stocking which can solve the problems set forth above.

According to the first aspect of the present invention, a sporting stocking comprises:

a stocking body; and at least one of shank front pad, a shank back pad and a patella pad fitted on the stocking body in non-removably integrated at predetermined positions.

In the preferred construction, at least one of a knit fabric located in opposition to a shin portion of a wearer's leg, a knit fabric located in opposition to a calf of the wearer's leg and a knit fabric located in opposition to a knee portion is formed as a double knit fabric defining a receptacle space for receiving corresponding one of the shank front pad, the shank back pad and the patella pad in non-removable integral fashion.

Preferably, on at least one of an inner surface of a knit fabric located in opposition to a shin portion of a wearer's leg, an inner surface of a knit fabric located in opposition to a calf of the wearer's leg and an inner surface of a knit fabric located in opposition to a knee portion, corresponding one of the shank front pad, the shank back pad and the patella pad is non-removably and integrally secured by bonding or welding. In the alternative, on at least one of a surface of a knit fabric located in opposition to a shin portion of a wearer's leg, a surface of a knit fabric located in opposition to a calf of the wearer's leg and a surface of a knit fabric located in opposition to a knee portion, corresponding one of the shank front pad, the shank back pad and the patella pad in non-removable integral fashion is non-removably and integrally secured by bonding or welding.

In the further preferred construction, on a surface of a knit fabric located in opposition to a shin portion of a wearer's leg, the shank front pad is non-removably and integrally secured by bonding or welding, and the shank front pad is covered by a covering member formed of a knit fabric the same as the knit fabric located in opposition of the shin portion of the wearer's leg. On the other hand, on a surface of a knit fabric located in opposition to a patella portion of a wearer's leg, the patella pad is non-removably and integrally secured by bonding or welding, and the patella pad is covered by a covering member formed of a knit fabric the same as the knit fabric located in opposition of the patella portion of the wearer's leg.

Preferably, the shank front pad is formed with a pad member including a cross-sectionally quadrangular bar shaped shock absorbing member of a rubber sponge or a synthetic resin sponge and a plate shaped shock receiving member fixedly secured on the shock absorber member. In the further preferred construction, the shank front pad is formed with a plurality of pad members, each of the pad member includes a cross-sectionally quadrangular bar shaped shock absorbing member of a rubber sponge or a synthetic resin sponge and a plate shaped shock receiving member fixedly secured on the shock absorber member, the pad members are arranged in parallel relationship and covered with an air permeable cover members over entire periphery of each individual pad member and over whole assembly with bonding peripheral edges of the air permeable cover members for forming a projecting edge portion. Also, the shank back pad is formed with a cross-sectionally quadrangular bar shaped or plate shaped shock absorbing member of a rubber sponge or a synthetic resin sponge. Similarly, the patella pad is formed with a large diameter annular shock absorbing member, a medium diameter annular shock absorbing member and a small diameter annular shock absorbing member of a rubber sponge or a synthetic resin sponge.

According to the second aspect of the present invention, a knitting method of sporting stocking comprises steps of:

forming at least one of a knit fabric located in opposition to a shin portion of a wearer's leg, a knit fabric located in opposition to a calf of the wearer's leg and a knit fabric located in opposition to a knee portion as a double knit fabric consisted of a surface knit portion and an inner knit portion defining a receptacle space for receiving corresponding one of the shank front pad, the shank back pad and the patella pad in non-removable integral fashion;

supporting the corresponding one of the shank front pad, the shank back pad and the patella pad in non-removable integral fashion within the receptacle space; and non-removably and integrally fixing the corresponding one of the shank front pad, the shank back pad and the patella pad in non-removable integral fashion on at least one of the surface knit portion and the inner knit portion by sewing thereon.

BRIEF DESCRIPTION OF THE DRAWINGS

The present invention will be understood more fully from the detailed description given hereinafter and from the accompanying drawings of the preferred embodiment of the present invention, which, however, should not be taken to be limitative to the invention, but are for explanation and understanding only.

In the drawings.

DESCRIPTION OF THE PREFERRED EMBODIMENT

Figure 1:
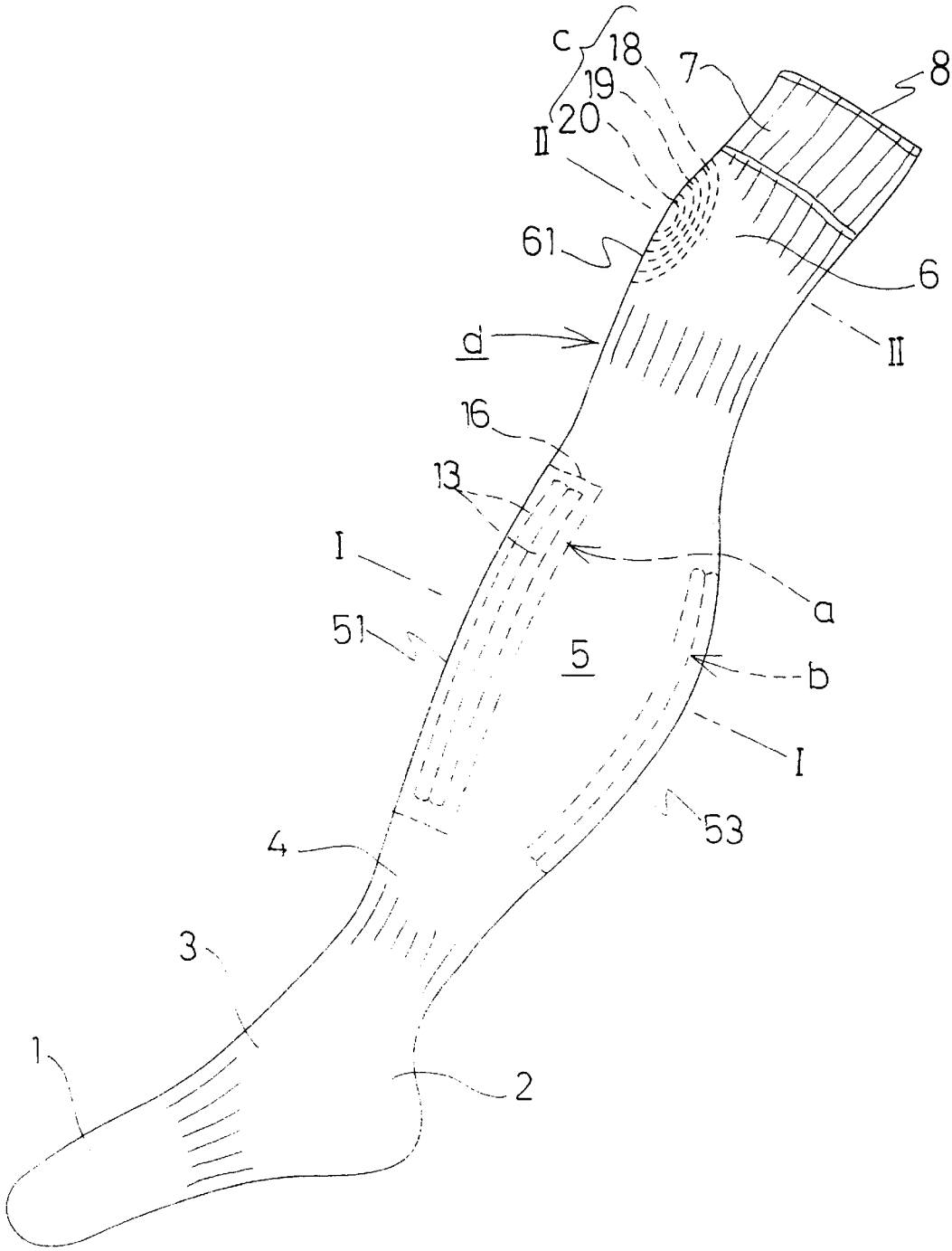
FIG. 1 is a perspective view of one embodiment of a sporting stocking according to the present invention.
Figure 2:
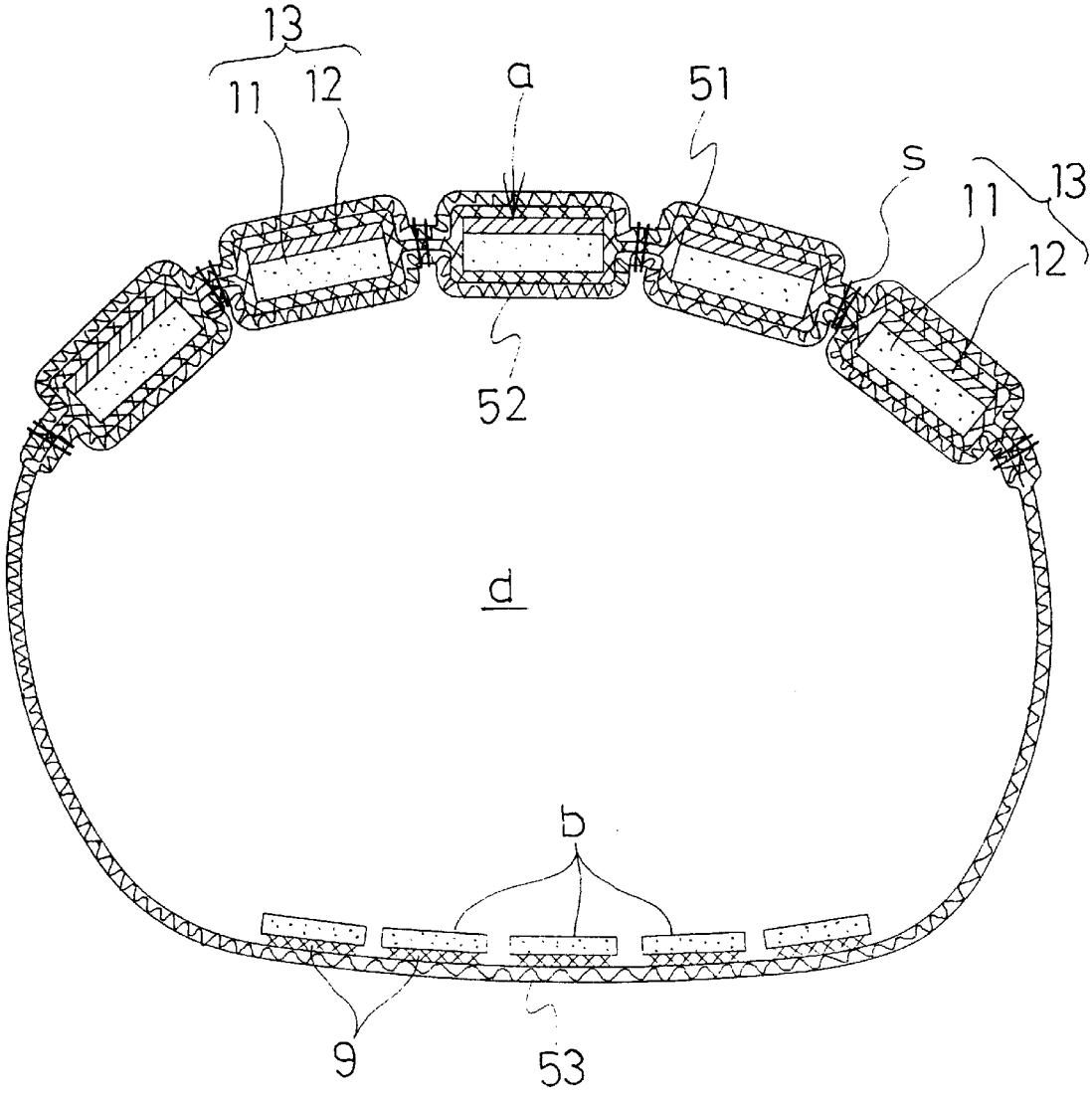
FIG. 2 is a section taken along line I—I of FIG. 1.
Figure 3:
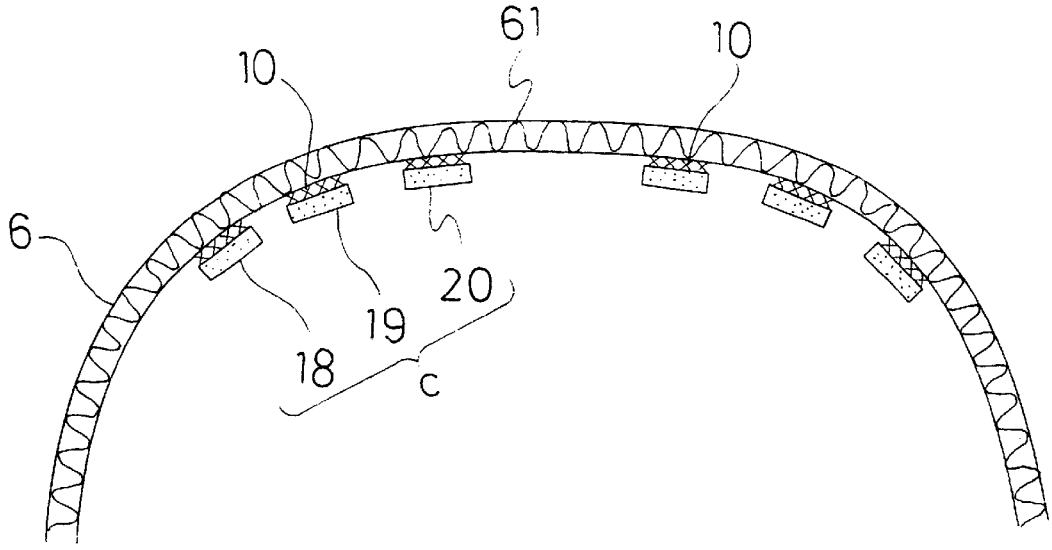
FIG. 3 is a section of a major portion taken along line II—II of FIG. 1.
Figure 4:
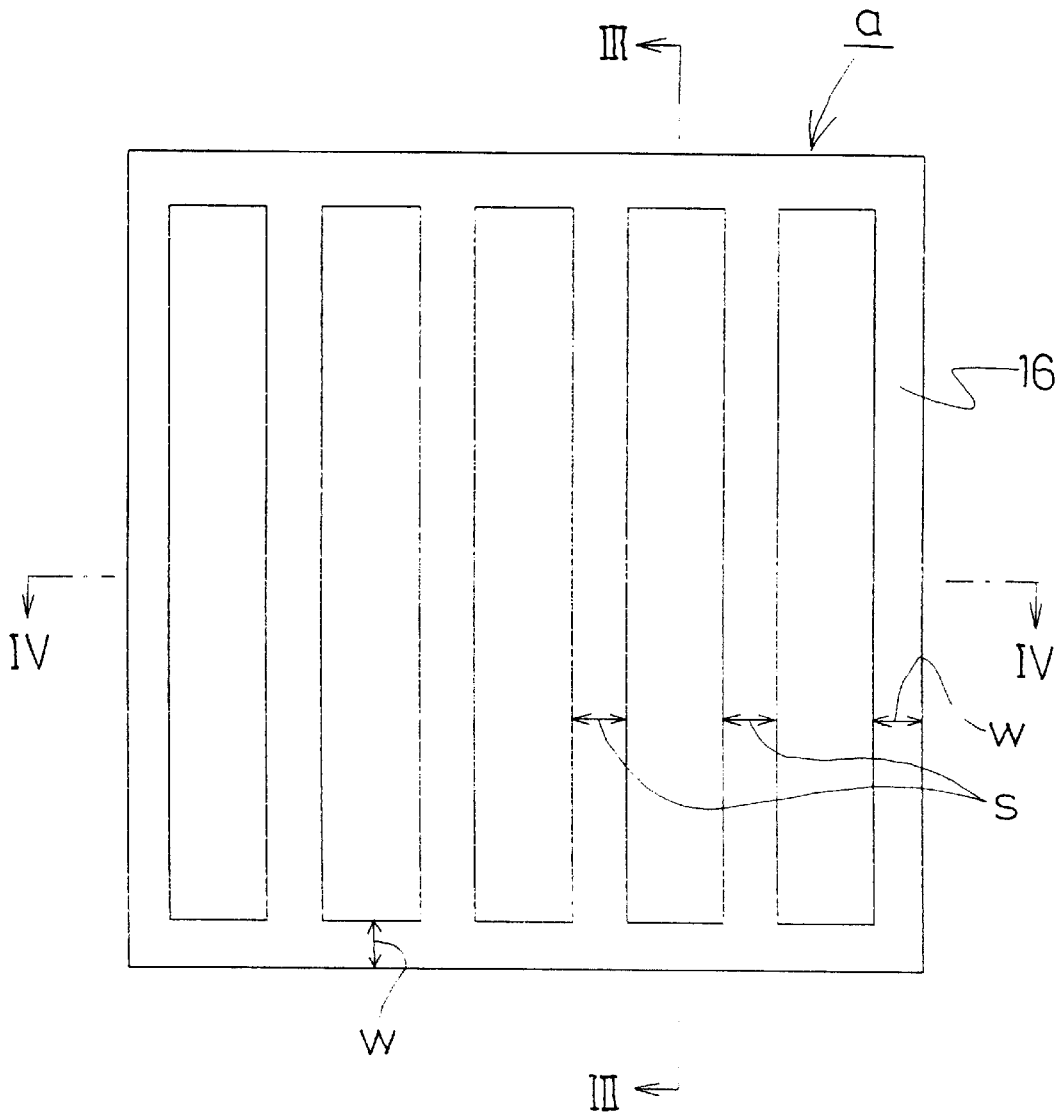
FIG. 4 is a plan view of shank front pad.
Figure 5:
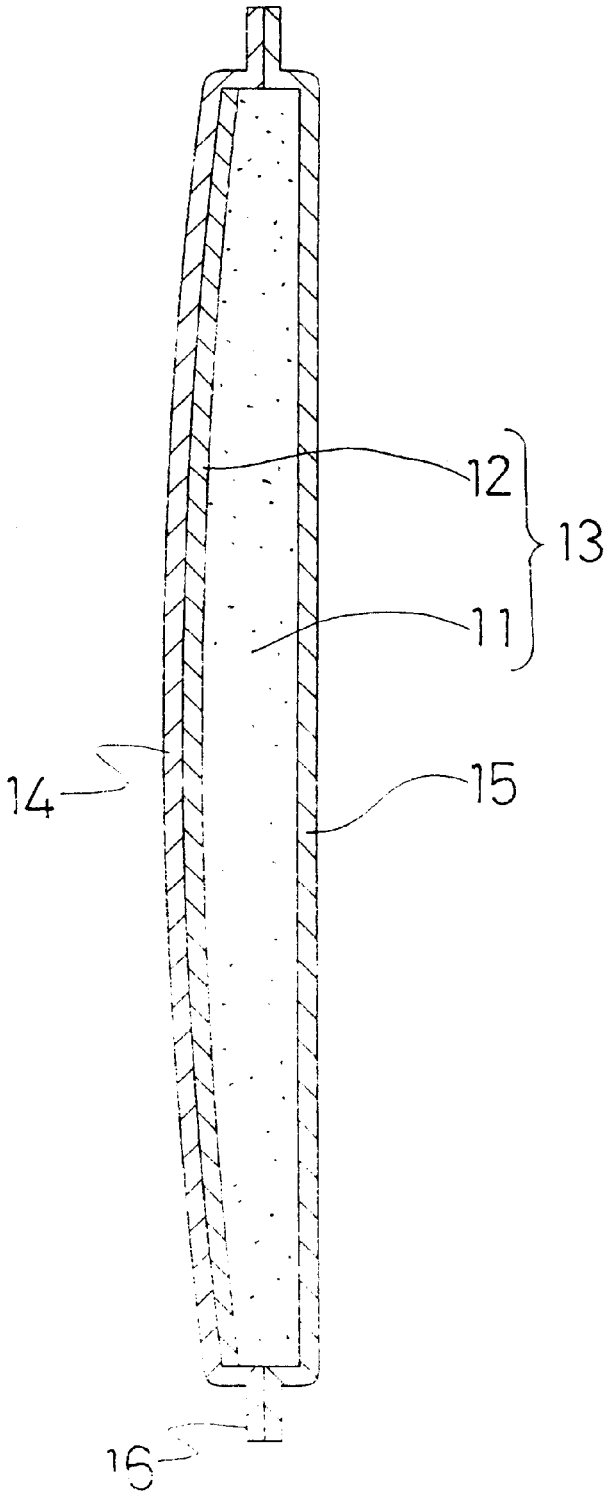
FIG. 5 is a section taken along line III—III of FIG. 4.
Figure 6:
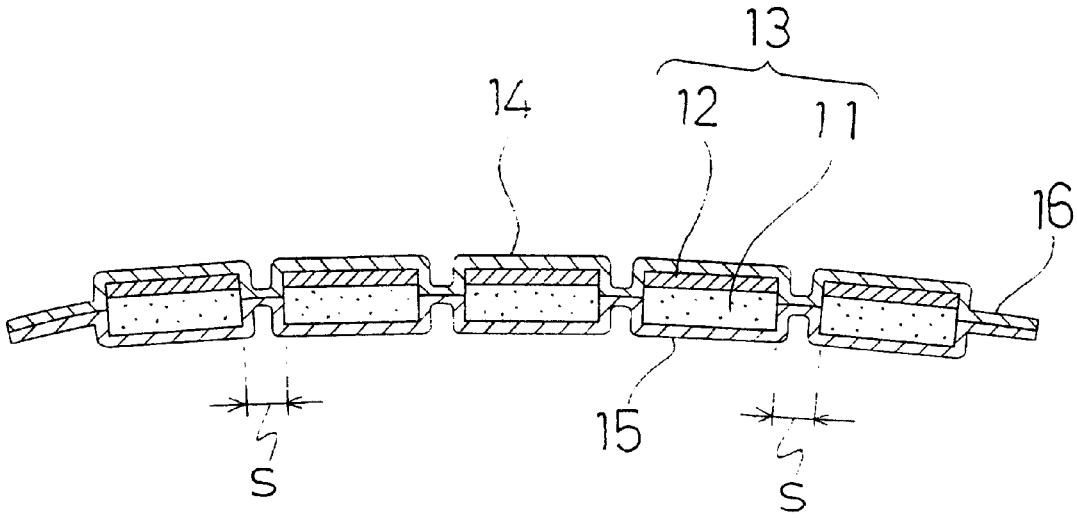
FIG. 6 is a section taken along line IV—IV of FIG. 4.
Figure 7:
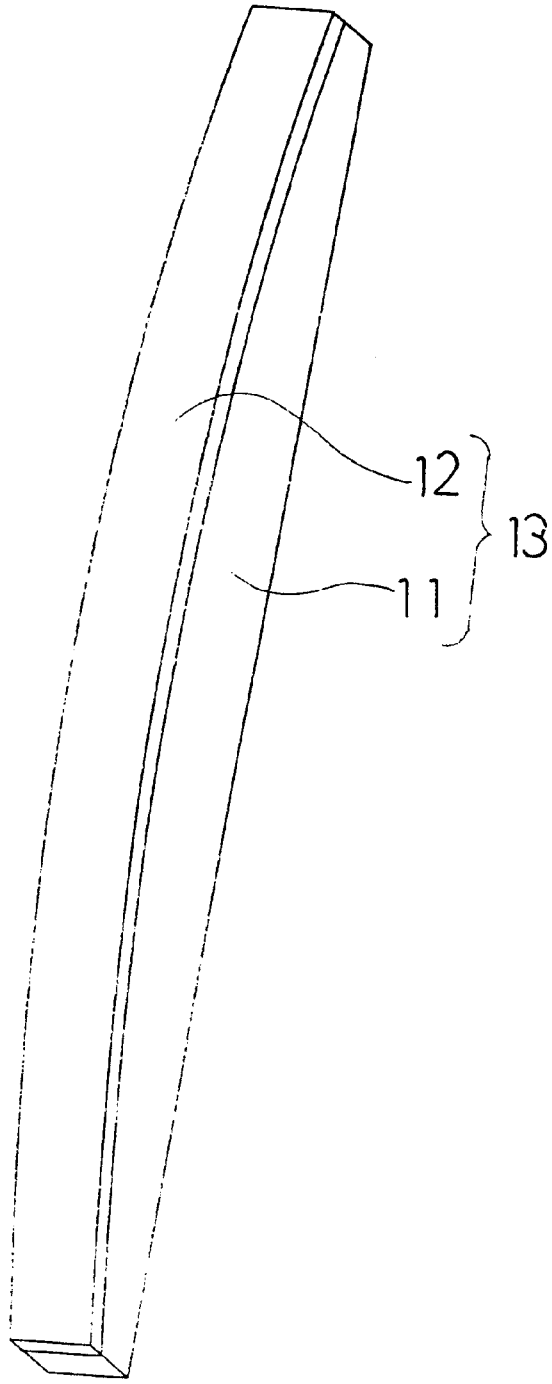
FIG. 7 is a perspective view of a pad member forming the shank front pad.
Figure 8:
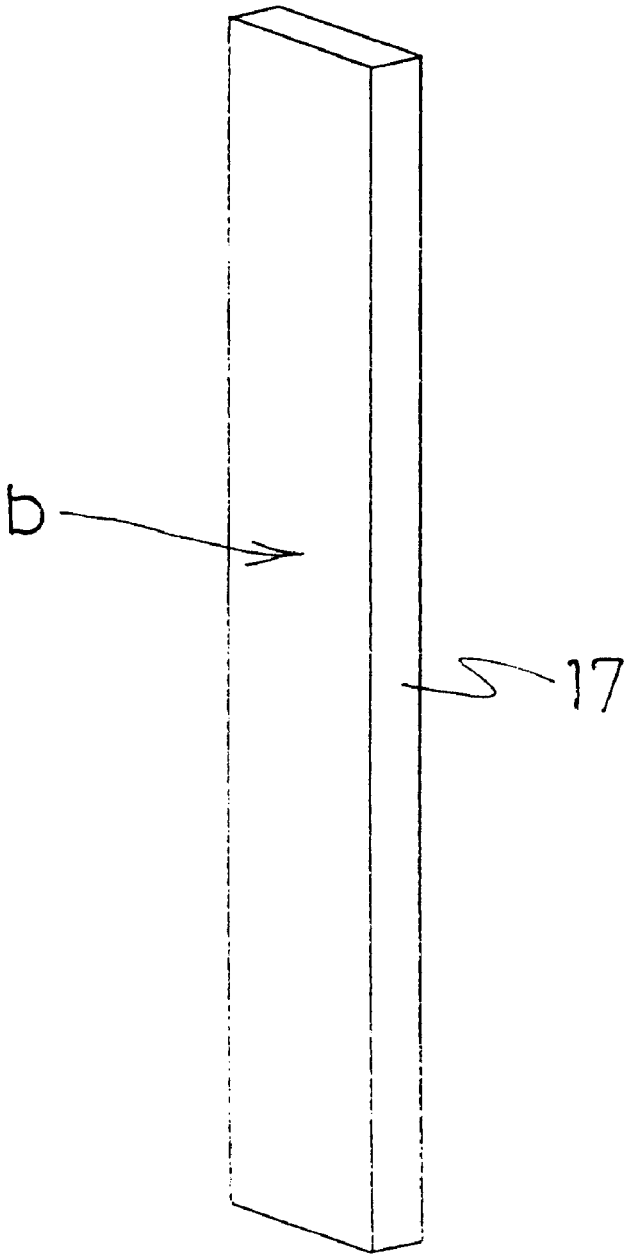
FIG. 8 is a perspective view of a shock absorbing member as shank back pad.
Figure 9:
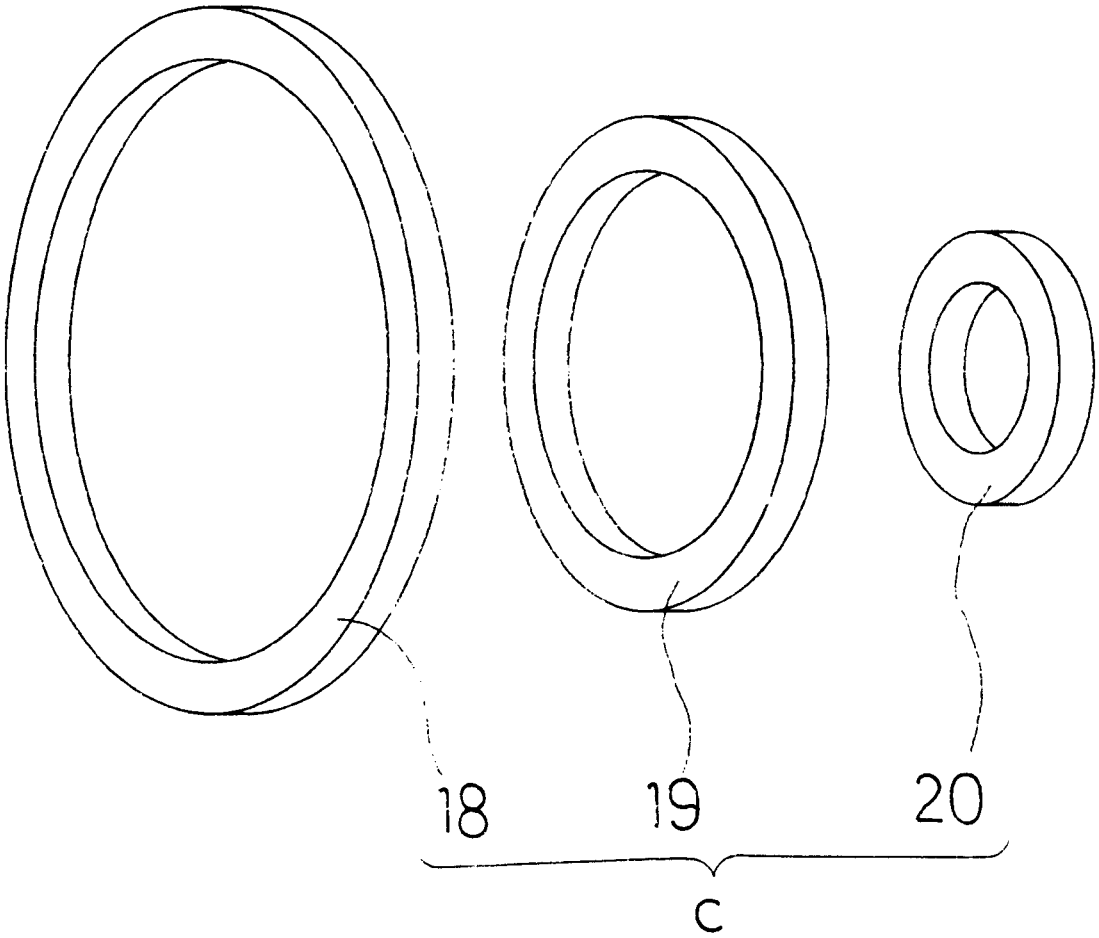
FIG. 9 is a perspective view of large, medium and small diameter annular shock absorbing members forming a patella pad.

The present invention will be discussed hereinafter in detail in terms of the preferred embodiment of the present invention with reference to the accompanying drawings. In the following description, numerous specific details are set forth in order to provide a thorough understanding of the present invention. It will be obvious, however, to those skilled in the art that the present invention may be practiced without these specific details. In other instance, well-known structure is not shown in detail in order to avoid unnecessary obscurity of the present invention.

One embodiment of a sporting stocking according to the present invention will be discussed hereinafter in detail in terms of a sporting stocking having a shank front pad a, a shank back pad b and a patella pad c with reference to the drawings.

A stocking body d has a foot portion 3 including a toe portion 1 and a heel portion 2, a leg portion continuous with an ankle portion 4 of the foot portion 3, a knee portion 6 continuous with the leg portion 5 and a rib top 7 and welt 8 continuous to the knee portion 6.

In the leg portion 5, within a predetermined range of front side opposing to the front side of the shank, namely opposing to the shin, a pad receptacle formed with a surface knit portion 51 and an inner knit portion 52 wrapping a shank front pad a in non-removable fashion. Thus, the shank front pad a is integrated with the shank portion of the stocking by wrapping with the surface knit portion 51 and the inner knit portion 52.

Furthermore, in the leg portion 5, within a predetermined range of back side opposing to back side of the shank, namely opposing to calf, a shank back pad b is bonded on an inner surface of a knit portion 53 by an appropriate adhesive or bond. Therefore, the shank back pad b is integrated with the shank back portion of the stocking.

In the knee portion 6, within a predetermined range on the inner surface of a knit portion 61 opposing to a front side of knee, namely opposing to a patella, a patella pad c is fixedly secured by bonding with an appropriate adhesive or bond 10. Thus, the patella pad c is integrated on the knee portion of the stocking in non-removable fashion.

The shank front pad a is formed with pad members 13, each formed a across-sectionally quadrangular bar shaped shock absorbing member 11 formed from a rubber sponge, synthetic resin sponge or the like, and a plate form shock receiving member 12 formed of a synthetic resin. The pad member 13 is formed by stacking the shock absorbing member 11 on the shock receiving member 12. The pad members 13 are arranged in parallel relationship with a given interval s and are wrapped the entire periphery and whole members with air permeable covering members 14 and 15, such as non-woven fabric or the like, for linking with reach other, for forming shank front pad assembly. On the circumference of the shank front pad assembly, the air permeable members 14 and 15 are stacked and bonded along peripheral edge for forming projecting edge portion 16 of the predetermined width w.

Upon knitting the surface knit portion 51 and the inner knit portion 52, namely upon knitting double knit fabric, the shank front pad a is supported between the surface knit portion 51 and the inner knit portion 52 by an appropriate means. Also, respective interval portions s between the shock absorbing members 11 of the projecting edge portion 16 are sewn by at least one of knitting yarns. Thus, the shank front pad a is non-removably secured in the predetermined range of the front portion of the leg portion 5.

The shank back pad b is formed with a plurality of shock absorbing members 17, each of which is formed into cross-sectionally quadrangular bar-shaped or plate shaped shock absorbing member 17 formed from rubber sponge or synthetic resin sponge. A given number of shock absorbing members 17 are fixedly secured on the inner surface of the predetermined range of back side of the leg portion 5. Thus, the shock absorbing members 17 are fixedly secured in opposition to the calf by appropriate bonding or welding. Thus, the shock absorbing members 17 are non-removably and thus integrally fixed in the back side of the leg portion 5.

The patella pad c is consisted of the large diameter annular shock absorbing member 18, the medium diameter annular shock absorbing member 19 and the small diameter annular shock absorbing member 20 respectively formed from rubber sponge or synthetic resin sponge.

The patella pad c is formed by arranging the large, medium and small diameter shock absorbing members 18, 19 and 20 in concentrically on the inner surface of the knit portion 61 within the predetermined range of the patella portion 6 opposing the patella, and is fixedly secured by appropriate bond 10 or welding. Thus, the patella pad c is non-removably fixed on the knee portion of the stocking.

The sporting stockings of the present invention constructed as set forth above, are provided in several kings with various sizes adapting to children, students adults, and so forth. Accordingly, the players may fit the shank front pad a, the shank back pad b and the patella pad c respectively at appropriate positions of the legs only by wearing the appropriate size of the sporting stocking of the present invention.

Furthermore, since the shank front pad a is formed by arranging a plurality of the pad members 13 in parallel relationship with the given interval, the shank back pad b is formed by a plurality of shock absorbing members 17 arranged with the given interval, and the patella pad c is formed by the large medium and small annular shock absorber members 18, 19 and 20 arranged with the given interval, for respectively providing satisfactory flexibility. Therefore, in comparison with an integral synthetic resin plate, respective pad members and the shock absorbing members are well fit on respectively opposing portions of the leg to give little uncomfortable feeling.

Although the present invention has been illustrated and described with respect to exemplary embodiment thereof, it should be understood by those skilled in the art that the foregoing and various other changes, omission and additions may be made therein and thereto, without departing from the spirit and scope of the present invention. Therefore, the present invention should not be understood as limited to the specific embodiment set out above but to include all possible embodiments which can be embodied within a scope encompassed and equivalent thereof with respect to the feature set out in the appended claims.

For instance, the following modifications may be considered.

(1) The foregoing discussion has been given in terms of the embodiment where the shank front pad a, the shank back pad b and the patella pad c are provided. However, the present invention is applicable for embodiments provided with one or two of these pads.

(2) Also, in the foregoing embodiment, the shank front pad a is provided by disposing the pad members within the double knit fabric formed in the predetermined range of the front side on front side of the shank of the leg portion 5, namely between the surface side knit portion 51 and the inner side knit portion 52.

Figure 10:
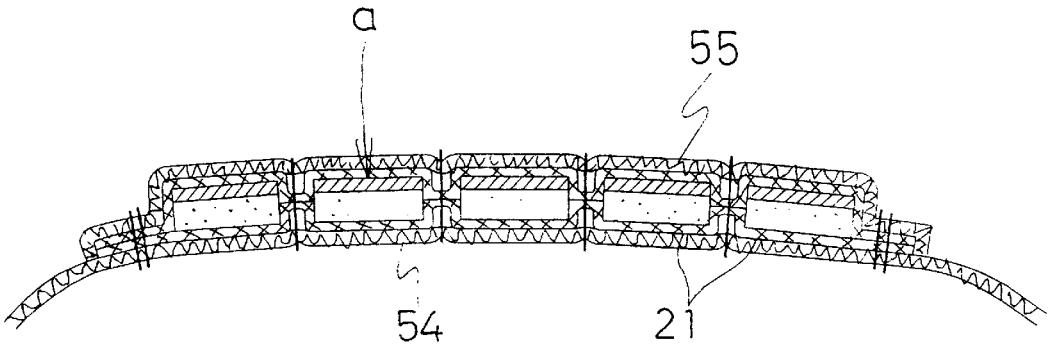
FIG. 10 is a major portion of end surface of a modification in a condition where the shank front pad is mounted.
Figure 11:
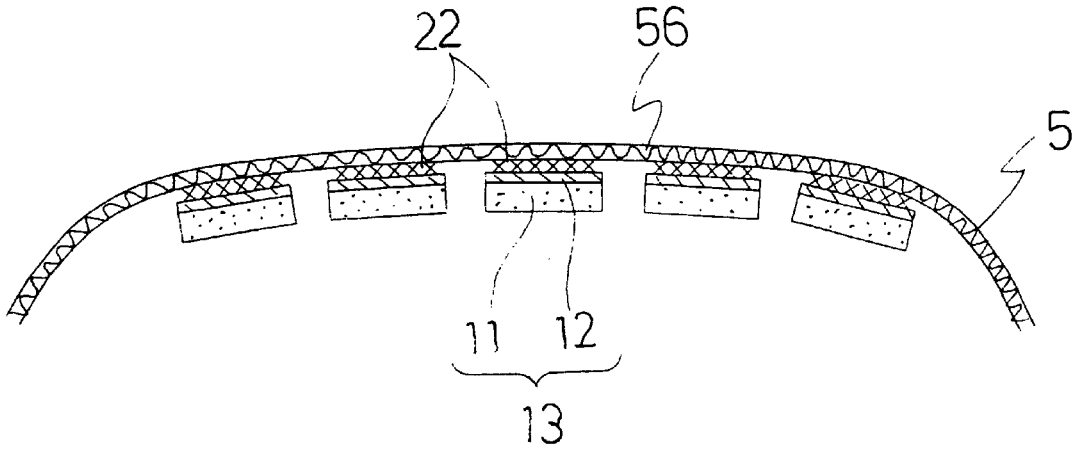
FIG. 11 is a major portion of engine surface of the modification in a condition where the shank front pad is mounted.

However, the present invention is not limited even for the foregoing modifications. For example, as shown in FIG. 10, the predetermined range of the front side portion of the leg portion opposing to the shin can be formed by a single knit fabric 54. Then, on the inner surface of the single knit fabric 54, the shank front pad a is fixedly secured by appropriate bond or welding. Then, separately prepared cover member, such as knit fabric 55 knitted similar manner as the single knit fabric 54 may be sewn, bonded, welded or other method with covering the shank front pad a.

On the other hand, it is also possible to form the shank front pad a with the pad member 13 formed by stacking the cross-sectionally rectangular shape shock absorbing member 11 of rubber sponge or synthetic resin sponge and the plate shaped shock receiving member 12 of synthetic resin, and a plurality of pad members 13 are simply secured by bond 22 or welding on the inner surface of the single knit fabric 56 formed within the predetermined range of front side of the leg 5 with the given interval.

(3) In the foregoing embodiment, the shank back pad b is fixedly secured on the knit fabric 53 in the predetermined range on the back side of the leg 5 by the bond 9 or welding, and the patella pad c is fixedly secured on the predetermined range of the knit fabric 61 of the knee portion by the bond 10 or welding.

However, the shank back pad b and the patella pad c may be secured on the surface side of the knit fabrics 53 and 61 by bonding or welding.

On the other hand, it is also possible to form the double knit fabric with the knit fabrics 53 and 61 to non-removably wrap the shank back pad b and the patella pad c therein.

(4) The construction of the shank front pad a, the shank back pad b and the patella pad c per se is not limited to those discussed in the embodiment and the modifications thereof as set forth above. Any constructions and materials may be employed as long as capable of protecting the player's leg and can be integrally and non-removably secured in or on the stocking.

As can be clear from the above, the sporting stocking according to the present invention can achieve the following effects.

Since one or two or more of the shank front pad, the shank back pad and the patella pad are provided on predetermined positions of the stocking body in non-removably integrated fashion, the player may fit the pads at respectively predetermined positions only by selecting appropriate size of stocking.

Namely, the player is not required to fit the protector by means of the accessory, to insert the protector into the pocket or to engage with the engaging member on the stocking. Also, it can successfully prevent the wearer or player from neglecting fitting of the protector.

On the other hand, since the shank front pad, the shank back pad and the patella pad are integrally secured at the predetermined positions on the stocking, such pads may not given uncomfortable feeling and will not cause offsetting from the predetermined positions during playing.

Also, with the sporting stocking knitting method according to the present invention, the shank front pad, the shank back pad and the patella pad are fitted on the knit fabrics at the predetermined position of the front side in opposition to the front side of the shank. The knit fabric can be double knit fabric consisted of the surface knit portion and the inner knit portion for receiving the shock absorbing pad therein in non-removably integrated fashion. Thus, the sporting stocking, in which the shank front pad, the shank back pad and the patella pad are non-removably integrated, can be knitted easily and certainly.

What is claimed is:

1. A sporting stocking comprising:

a stocking body comprising an inner surface; and at least one of a shank front pad, a shank back pad and a patella pad fitted on said stocking body in non-removably integral fashion in a predetermined position;

wherein on at least one of said inner surface of a knit fabric located in opposition to a shin portion of a wearer's leg, an inner surface of a knit fabric located in opposition to a calf of the wearer's leg and an inner-surface of a knit fabric located in opposition to a knee portion, corresponding one of said shank front pad, said shank back pad and said patella pad is non-removably and integrally secured by bonding or welding, and wherein the inner surface not located in opposition to said shin, said calf and said knee portions is not fitted with a pad.

2. A sporting stocking comprising:

a stocking body comprising a surface; and at least one of a shank front pad, a shank back pad and a patella pad fitted on said stocking body in non-removably integral fashion in a predetermined position;

wherein on at least one of said surface of a knit fabric located in opposition to a shin portion of a wearer's leg, a surface of a knit fabric located in opposition to a calf of the wearer's leg and a surface of a knit fabric located in opposition to a knee portion, corresponding one of said shank front pad, said shank back pad and said patella pad in non-removable integral fashion is non-removably and integrally secured by bonding or welding, and wherein the surface not located in opposition to said shin, said calf and said knee portions is not fitted with a pad.

3. A sporting stocking comprising:

a stocking body comprising a surface; and a shank front pad fitted on said stocking body in non-removably integral fashion in a predetermined position;

wherein on said surface of a knit fabric located in opposition to a shin portion of a wearer's leg, said shank front pad is non-removably and integrally secured by bonding or welding, and said shank front pad is covered by a covering member formed of a knit fabric the same as said knit fabric located in opposition of the shin portion of the wearer's leg, and wherein the surface not located in opposition to said shin portion is not fitted with a pad.

4. A sporting stocking comprising:

a stocking body comprising a surface; and a patella pad fitted on said stocking body in non-removably integral fashion in a predetermined position;

wherein on a surface of a knit fabric located in opposition to a patella portion of a wearer's leg, said patella pad is non-removably and integrally secured by bonding or welding, and said patella pad is covered by a covering member formed of a knit fabric the same as said knit fabric located in opposition of the patella portion of the wearer's leg, and wherein the surface not located in opposition to said patella portion is not fitted with a pad.

5. A sporting stocking comprising:

a stocking body; and a shank front pad fitted on said stocking body in non-removably integral fashion in a predetermined position;

wherein said shank front pad is formed with a pad member including a cross-sectionally quadrangular bar shaped shock absorbing member of a rubber sponge or a synthetic resin sponge and a plate shaped shock receiving member fixedly secured on said shock absorber member.

6. A sporting stocking comprising:

a stocking body; and a shank front pad fitted on said stocking body in non-removably integral fashion in a predetermined position;

wherein said shank front pad is formed with a plurality of pad members, each of said pad member includes a cross-sectionally quadrangular bar shaped shock absorbing member of a rubber sponge or a synthetic resin sponge and a plate shaped shock receiving member fixedly secured on said shock absorber member, said pad members are arranged in parallel relationship and covered with an air permeable cover members over entire periphery of each individual pad member and over whole assembly with bonding peripheral edges of said air permeable cover members for forming a projecting edge portion.

7. A sporting stocking comprising:

a stocking body; and a patella pad fitted on said stocking body in non-removably integral fashion in a predetermined position;

wherein said patella pad is formed with a large diameter annular shock absorbing member, a medium diameter annular shock absorbing member and a small diameter annular shock absorbing member of a rubber sponge or a synthetic resin sponge.

8. A knitting method of sporting stocking comprising:

forming at least one of a knit fabric located in opposition to a shin portion of a wearer's leg, a knit fabric located in opposition to a calf of the wearer's leg and a knit fabric located in opposition to a knee portion as a double knit fabric consisted of a surface knit portion and an inner knit portion defining a receptacle space for receiving corresponding one of said shank front pad, said shank back pad and said patella pad in non-removable integral fashion;

supporting said corresponding one of said shank front pad, said shank back pad and said patella pad in non-removable integral fashion within said receptacle space; and non-removably and integrally fixing said corresponding one of said shank front pad, said shank back pad and said patella pad in non-removable integral fashion on at least one of said surface knit portion and said inner knit portion by sewing thereon.

* * * * *